US005902098A

United States Patent [19]

Park

[11] Patent Number: 5,902,098

[45] Date of Patent: May 11, 1999

[54] METHOD FOR CONTROLLING AN IGNITION FOR A GAS BOILER

[75] Inventor: Jae-Gyeong Park, Incheon, Rep. of Korea

[73] Assignee: Daewoo Electronics Co., Ltd., Seoul, Rep. of Korea

[21] Appl. No.: 08/917,428

[22] Filed: Aug. 26, 1997

[30] Foreign Application Priority Data

Oct. 29, 1996 [KR] Rep. of Korea ..... 96 49766

[51] Int. Cl.[6] ..... F23M 5/20

[52] U.S. Cl. ..... 431/6; 431/20; 431/31; 431/69; 126/351

[58] Field of Search ..... 431/6, 20, 29, 431/30, 31, 18, 67, 73, 62, 69, 27; 126/116 R, 116 A, 350 R, 351

[56] References Cited

U.S. PATENT DOCUMENTS

| | | | |
|---|---|---|---|
| 3,221,799 | 12/1965 | Hamelink et al. | 431/31 |
| 4,439,140 | 3/1984 | Stout | 431/30 |
| 4,445,841 | 5/1984 | Tanaka et al. | 431/31 |
| 5,078,317 | 1/1992 | Kenner et al. | 431/29 |
| 5,195,886 | 3/1993 | Ida | 431/30 |
| 5,360,335 | 11/1994 | Anderson et al. | 431/6 |

FOREIGN PATENT DOCUMENTS

| | | |
|---|---|---|
| 0 359144 A2 | 3/1990 | European Pat. Off. . |
| 2283565 | 5/1995 | United Kingdom . |

*Primary Examiner*—James C. Yeung
*Attorney, Agent, or Firm*—Jacobson, Price, Holman & Stern, PLLC

[57] ABSTRACT

A method for controlling an igniting operation for a gas boiler for preventing an explosive ignition is disclosed. The gas boiler is equipped with a burner for burning a gas, a fan for exhausting a burnt gas in the burner, and an ignition plug for performing igniting operation of the gas supplied into the burner. If the operation of the gas boiler commences, the gas is supplied into the burner while the exhaust fan is operated at a low speed appropriate for performing the igniting operation, and the ignition plug is operated to perform the igniting operation of the gas in the burner. In that situation, if ignition does not occur during a predetermined time, the rotational velocity of the exhaust fan increases, whereby the density of gas in the burner is maintained constant. Thus, the excessive increasing of the gas density is prevented, so the explosive ignition is prevented.

3 Claims, 3 Drawing Sheets

METHOD FOR CONTROLLING AN IGNITION FOR A GAS BOILER

BACKGROUND OF THE INVENTION

1. Field of the Invention

The present invention relates to a method for controlling an igniting operation for a gas boiler in order to prevent an explosive ignition which may occur when density of gas in a burner is excessively increased during the igniting operation.

2. Prior Art

A gas boiler has a burner for heating water by burning a gas, a gas valve for controlling the amount of gas supplied into the burner, an ignition plug for performing an igniting operation of the gas supplied into the burner, and a microprocessor for controlling overall operation thereof. When a user sets a desired temperature for heating water or warming a house by the gas boiler, the microprocessor controls the supply of gas, igniting operation, and burning operation to maintain the set temperature. At the lower part of the burner, a plurality of ventilating ports are formed through which the air required for burning the gas is supplied, and the exhaust fumes in the burner are drawn off to the outside by an exhaust fan.

In such a gas boiler, the process for igniting the gas supplied into the burner is as follows. At first, the pre-purge process which draws off the noxious gas in the burner and in an exhaust pipe for drawing off the exhaust gas is performed by the operation of the exhaust fan. After the pre-purge process is completed, the rotational velocity of the exhaust fan is reduced to an appropriate speed for performing the igniting operation, and at the same time the electric discharge of the ignition plug begins and the gas is supplied into the burner. The gas supplied into the gas is ignited by the ignition plug, and thereafter the gas boiler performs the normal heating operation thereof.

However, according to such a conventional process for controlling the igniting operation, an explosive ignition may occur since the igniting operation is performed to the gas of excessively high density. That is, if the igniting operation has not been normally performed for a time period due to some reasons, the density of the gas in the burner increases gradually since the gas is supplied continuously until the igniting operation is re-performed, and then the explosive ignition occurs if the igniting operation is performed again to the gas of increased density. Such an explosive ignition may occur due to such reasons as the density of the gas supplied into the burner is inappropriate because of the reflow of air into the burner, or the igniting operation of the gas is not exactly performed by the alteration of the position of the ignition plug. Moreover, it may occur due to the reason that the supply of the gas is delayed at the initial time and the gas is supplied excessively thereafter. If such an explosive ignition occurs, great noise and vibration may be generated by the gas boiler, which may bring about the disorder of the gas boiler.

SUMMARY OF THE INVENTION

The present invention has been proposed to overcome the above described problems in the prior art, and accordingly it is an object of the present invention to provide a method for controlling an igniting operation for a gas boiler in which the explosive ignition is prevented when the igniting operation is performed, by preventing an excessive increase in the density of gas in the burner.

To achieve the above object, the present invention provides a method for controlling an igniting operation for a gas boiler equipped with a burner for burning a gas, a fan for exhausting a burnt gas in said burner, and an ignition plug for performing the igniting operation for the gas supplied into said burner, said method comprising the steps of: performing a pre-purge process which exhausts remaining gas in said burner by driving said exhaust fan, supplying the gas into said burner while driving said exhaust fan at a low speed which is appropriate for performing the igniting operation, operating said ignition plug in order to perform the igniting operation of the gas supplied into said burner, and increasing a rotational velocity of said exhaust fan if the gas is not ignited during a predetermined time, whereby a density of the gas in said burner is kept constant.

It is preferable to sense whether the gas is ignited after a total time set for performing the igniting operation, and if sensing indicates ignition did not occur, after performing the post-purge process which stops supplying the gas and drives the exhaust fan at a high speed to exhaust remaining gas in said burner, repeat the steps of the above-mentioned processes for controlling the igniting operation until the ignition is completed. Thus, even if the igniting operation is not performed exactly at the first time, the igniting operation can be performed exactly by the repetitive igniting operation.

Furthermore, it is more preferable that the rotational velocity of said exhaust fan is controlled to increase gradually, and the predetermined time is set to be half of the total time set for performing the igniting operation.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
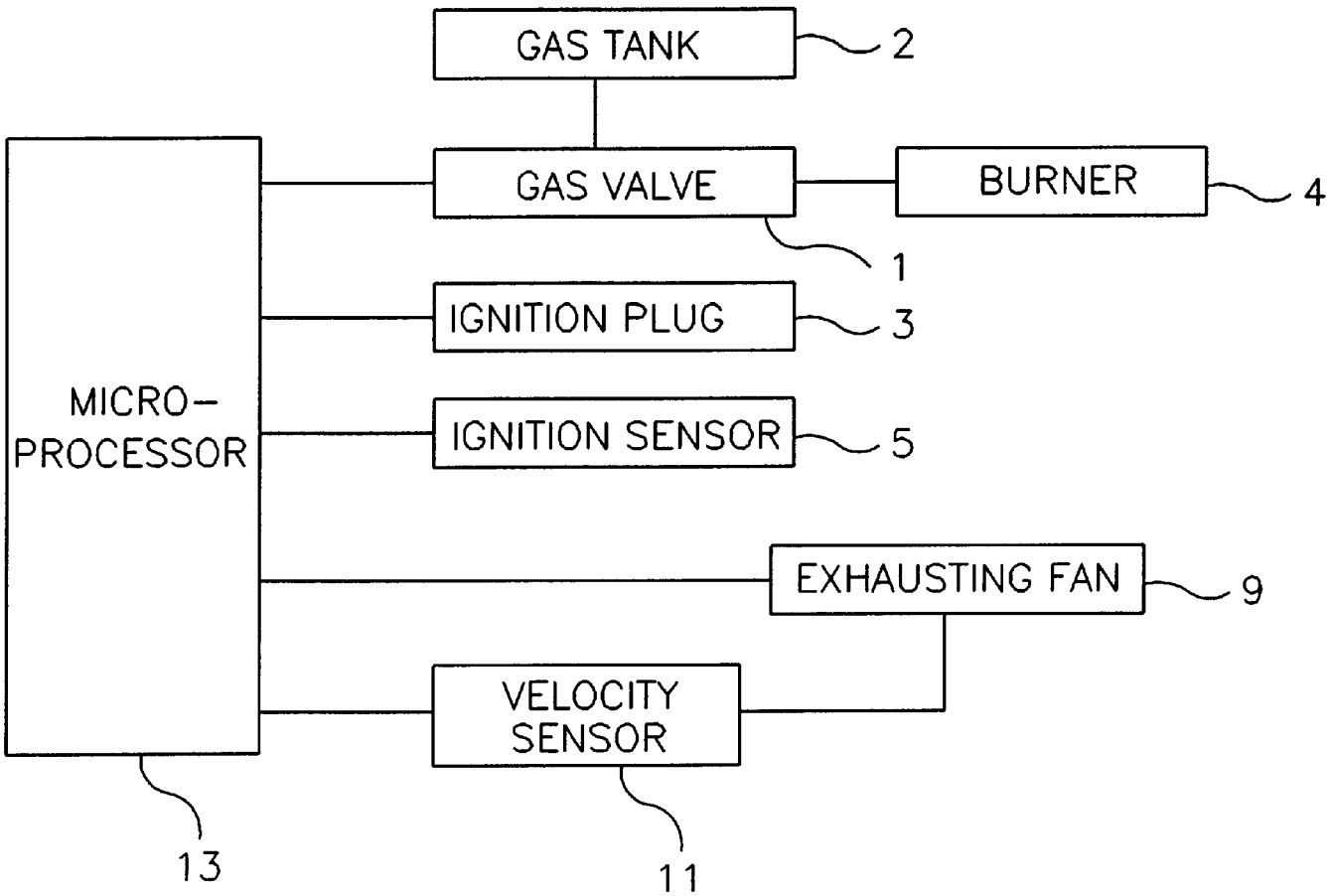
FIG. 1 is a block diagram showing the configuration of a gas boiler for performing the method according to the present invention.

FIG. 1 is a block diagram showing the configuration of a gas boiler for performing the method according to the present invention. The gas boiler has a gas tank 2 for accommodating gas to be burnt, a burner 4 for performing a combustion operation of the gas supplied from the gas tank 2, a gas valve 1 for controlling supply of gas into the burner 4, an ignition plug 3 for igniting the gas in the burner 4, an ignition sensor 5 for sensing the ignition, a fan 9 for exhausting the burnt gas from the burner 4, and a velocity sensor 11 for sensing the rotational velocity of the exhaust fan 9. The gas valve 1, the ignition plug 3, and the exhaust fan 9 are driven by a microprocessor 13, and the results of sensing by the ignition sensor 5 and the velocity sensor 11 are inputted into the microprocessor 13.

Figure 2:
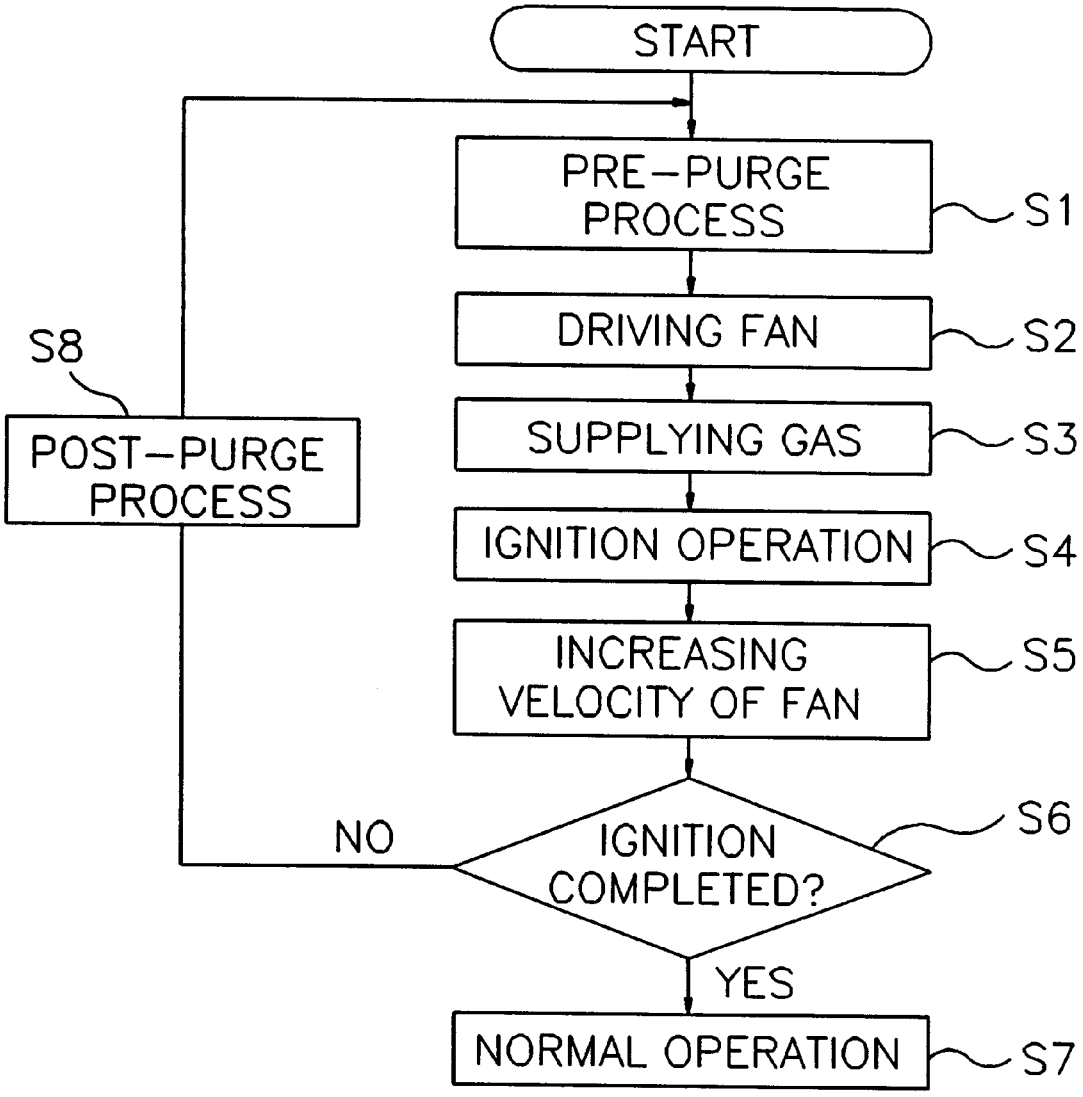
FIG. 2 is a flow chart showing the method for controlling the igniting operation for the gas boiler.
Figure 3:
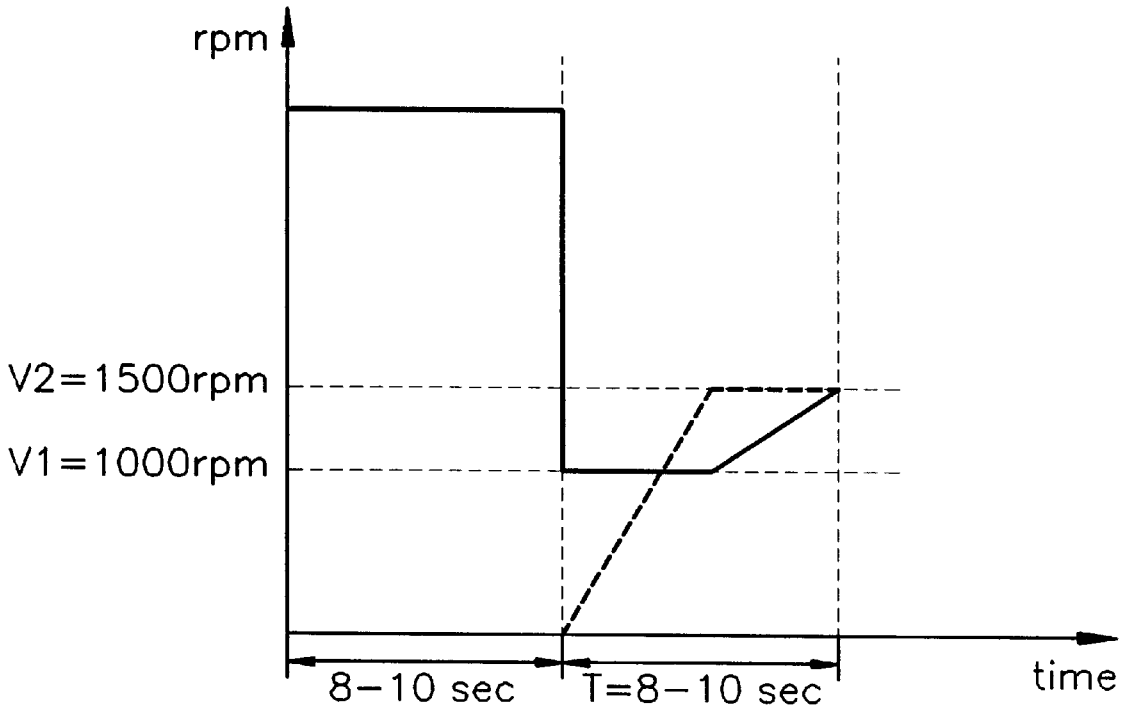
FIG. 3 is a graph illustrating the variation of the rotational velocity of the exhaust fan with a time basis according to the method for controlling the igniting operation of the present invention.

FIG. 2 is a flow chart showing the method for controlling the igniting operation for the gas boiler, and FIG. 3 is a graph illustrating the variation of the rotational velocity of the exhaust fan 9 with time base according to the method for controlling the igniting operation of the present invention. In FIG. 3, the rotational velocity of the exhaust fan 9 is indicated by a full line, and the variation of the density of the gas in the burner 4 is indicated by a dotted line. When the operation of the gas boiler commences, the microprocessor 13 performs the pre-purge process S1 which drives the exhaust fan 9 at a high speed to draw off the remaining burnt gas in the burner 4. If the remaining gas in the burner 4 is completely exhausted by the pre-purge process, the microprocessor 13 drives the exhaust fan 9 at a low speed which is appropriate for the igniting operation S2, and controls the gas valve 1 to supply the gas S3 into the burner 4. Almost at the same time with that situation, the microprocessor 13 operates the ignition plug 3 to perform the igniting operation S4, thereby the gas supplied into the burner 4 is ignited.

If the ignition does not occur due to a certain reason as mentioned above in a predetermined time t, the density of the gas in the burner 4 increases as the gas is supplied into the burner 4 continuously. Thus, the microprocessor 13 increases the rotational velocity of the exhaust fan 9 in order to increase the amount of the gas drawn off to the outside S5, thereby the density of the gas in the burner 4 is maintained constant. Therefore, an excessive increase of the density of the gas in the burner 4 is prevented during the continuous igniting operation by the ignition plug 3, so an explosive ignition does not occur. The exhaust fan 9 may, as illustrated in FIG. 3, be controlled to gradually increase in its rotational velocity, and be controlled to increase as a step function.

After performing such processes, the microprocessor 13 senses whether ignition occurred through the ignition sensor 5, S6. In the microprocessor 13, a total time T which is generally required to perform the normal igniting operation is pre-set, and the sensing whether ignition has occurred after such a total time T lapses. If the igniting operation has been normally performed, the gas boiler carries out normal heating operation S7, and if ignition is not sensed, the post-purge process is carried out S8. In the post-purge process, the microprocessor 13 drives the gas valve 1 to stop supplying the gas and drives the exhaust fan 9 at a high speed to draw off the remaining gas in the burner 4. After the completion of the post-purge process, the aforementioned processes are repeated until ignition occurs. Since the method for controlling the igniting operation according to the present invention is repeated if ignition doesn't occur, the igniting operation can be performed exactly.

The optimal density of the gas for the exact ignition, the rotational velocity and increasing rate thereof for the exhaust fan 9 for maintaining such an optimal gas density, and the time t for starting to increase the rotational velocity of the exhaust fan 9 are all determined experimentally. Preferably, the predetermined time t is set to be about half of the total time T required for performing the igniting operation which is pre-set in the microprocessor 13. In FIG. 3, the exemplary case is illustrated, in which the time duration for performing the pre-purge process and above mentioned total time T is set at approximately between 8 seconds and 10 seconds, the rotational velocity V1 appropriate for performing the igniting operation is set at 1000 rpm, and the increased rotational velocity V2 for maintaining the density of the gas constant is set at 1500 rpm. Such rotational velocities V1, V2, the total time T, and the starting time t to increase the rotational velocity of the exhaust fan 9 may be variable and can be modified to be optimal according to the kind of gas boiler. The rotational velocity of the exhaust fan 9 is sensed by the velocity sensor 11 and inputted into the microprocessor, so the microprocessor 13 can control the rotational velocity of the exhaust fan 9 and the gas density in the burner 4 more exactly.

As mentioned above, according to the present invention, since the excessive increase of the gas density in the burner 4 is prevented by increasing the rotational velocity of the exhaust fan 9 after the predetermined time from the beginning of the gas supply, the explosive ignition and the noise thereby is prevented.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A method for controlling an igniting operation for a gas boiler equipped with a burner for burning a gas, a fan for exhausting a burnt gas in said burner, and an ignition plug for performing the igniting operation for the gas supplied into said burner, said method comprising the steps of:

(a) performing a pre-purge process which exhausts remaining gas in said burner by driving said exhaust fan, (b) supplying the gas into said burner while driving said exhaust fan at a low speed which is appropriate for performing the igniting operation, (c) operating said ignition plug in order to perform the igniting operation of the gas supplied into said burner, and (d) increasing a rotational velocity of said exhaust fan if the gas is not ignited during a predetermined time, whereby a density of the gas in said burner is kept constant.

2. The method for controlling an igniting operation for a gas boiler as claimed in claim 1, further comprising the steps of:

(e) sensing whether the gas is ignited after a total time set for performing the igniting operation, and (f) performing a post-purge process which stops supplying the gas and drives the exhaust fan at a high speed to exhaust remaining gas in said burner and repeating the step (b) through the step (d) after the post-purge process until the igniting operation is completed.

3. The method for controlling an igniting operation for a gas boiler as claimed in claim 1, wherein the rotational velocity of said exhaust fan increases gradually in the step (d).

* * * * *